US005635440A

United States Patent [19]

Eguchi et al.

[11] Patent Number: 5,635,440

[45] Date of Patent: Jun. 3, 1997

[54] THERMAL TRANSFER SHEET FOR FORMATION OF COLOR IMAGE

[75] Inventors: Hiroshi Eguchi; Yusuke Nakamura, both of Tokyo, Japan

[73] Assignee: Dai Nippon Printing Co., Ltd., Japan

[21] Appl. No.: 247,979

[22] Filed: May 23, 1994

[30] Foreign Application Priority Data

May 25, 1993 [JP] Japan ..... 5-144426
Dec. 20, 1993 [JP] Japan ..... 5-344483

[51] Int. Cl.[6] ..... B41M 5/035; B41M 5/38

[52] U.S. Cl. ..... 503/227; 428/195; 428/323; 428/484; 428/500; 428/913; 428/914

[58] Field of Search ..... 8/471; 428/195, 428/913, 914, 323, 484, 500; 503/227

[56] References Cited

U.S. PATENT DOCUMENTS

| | | | |
|---|---|---|---|
| 4,990,484 | 2/1991 | Nakamura | 503/227 |
| 5,081,101 | 1/1992 | Evans et al. | 503/227 |
| 5,214,023 | 5/1993 | Aono | 503/227 |
| 5,270,285 | 12/1993 | Ito et al. | 503/227 |
| 5,369,078 | 11/1994 | Eguchi | 503/227 |

FOREIGN PATENT DOCUMENTS

| | | | |
|---|---|---|---|
| 0270677 | 6/1988 | European Pat. Off. | 503/227 |
| 0383212 | 8/1990 | European Pat. Off. | 503/227 |
| 4-148988 | 5/1992 | Japan | 503/227 |
| 4-211993 | 8/1992 | Japan | 503/227 |

*Primary Examiner*—Bruce H. Hess
*Attorney, Agent, or Firm*—Parkhurst, Wendel & Burr, L.L.P.

[57] ABSTRACT

A thermal transfer sheet for the formation of a color image having a high heat sensitivity and providing a full-color image having good color density and light fastness even when the heat energy applied is low and, at the same time, realizing very excellent reproduction in a wide range of colors. The thermal transfer sheet for the formation of a color image includes a substrate sheet and, formed on one surface of the substrate sheet in a successive manner, dye layers of at least three colors of yellow, magenta and cyan respectively including dyes of three colors of yellow, magenta and cyan and resin binders for respective dyes, wherein the yellow dye is a dye represented by the formulae (1) and/or (2), the magenta dye is at least one member selected from the group consisting of dyes represented by the following formulae (3) to (5) and the cyan dye is a dye represented by the formulae (6) and/or (7).

11 Claims, 6 Drawing Sheets

THERMAL TRANSFER SHEET FOR FORMATION OF COLOR IMAGE

BACKGROUND OF THE INVENTION

The present invention relates to a thermal transfer sheet for the formation of a color image. More particularly, it is concerned with a thermal transfer sheet for the formation of a high-sensitivity full-color image, which thermal transfer sheet can reproduce a wide range of colors comparable to various types of conventional color printing on a commercial scale and can provide images having excellent light fastness.

Color printing has hitherto been carried out in large volumes by offset printing, gravure printing or other printing methods. In such color printing, an original per se or a combination of an original with other originals, letters, symbols and the like is subjected to color separation to prepare plates for three colors of cyan, magenta and yellow. A plate for black is further prepared according to need, and the hue and pattern of the original is reproduced using printing inks for respective colors.

In most cases, pigments are used as colorants for inks of three primary colors of cyan, magenta and yellow in the above printing system. In this case, three primary color pigments known to be best suited for color printing from various experience in the past are selected so that a wide variety of colors ranging from the three primary colors to colors intermediate between them can be reproduced.

The above-described conventional printing system has a problem that high equipment cost and large space are necessary because it is indispensable to always prepare plates respectively for the three primary colors or plates respectively for four colors (i.e., black in addition to the three primary colors). For example, color printing cannot be simply carried out in small workshops and offices.

In order to solve the above problem, a proposal has been made on a thermal transfer system where a thermal transfer sheet for three primary colors is prepared using sublimable (or thermomigratory) dyes and the dyes are transferred by means of thermal energy using the thermal transfer sheet system requires neither a large printing machine nor other various equipment and enables color images to be simply formed, which renders the thermal transfer system promising.

In the above-described thermal transfer system, a material, to which an image is to be transferred, and a thermal transfer sheet are put on top of the other, and thermal energy is applied by a thermal head or other means from either the material, to which an image is to be transferred, or the thermal transfer sheet, thus causing dyes on the thermal transfer sheet to be transferred to the material to which an image is to be transferred. Color dots formed by the transfer have much larger size than dots (halftone dots) in the conventional offset printing. Further, in the case of printing inks, the color density of halftone dots can be changed as desired mainly by regulating the size of halftone dots. On the other hand, in the thermal transfer system, a change in dot size is difficult, and the density difference should be varied by varying thermal energy applied.

For this reason, it is ideal for the magnitude of thermal energy applied to be proportional to the density of dots to be transferred. In the conventional thermal transfer sheet, however, the migration of dyes, that is, the color density, is poor particularly when the thermal energy is low. Further, since it is practically impossible to regulate the migration of the three primary colors on the same level, the reproduction of a relatively light color is unsatisfactory and, at the same time, intermediate colors having satisfactory gradation cannot be formed.

Further, in the case of a full-color image formed by the above-described system, if a dye having a poor light fastness is used even for only one color, the light fastness of the full-color image as a whole is poor even when the other dyes used have an excellent light fastness. Although dyes having an excellent light fastness are individually known, a combination of dyes capable of providing an excellent full-color image through a combination of the three primary colors is not known in the art.

Further, in most cases, the three primary colors in the conventional offset printing inks comprise pigments. On the other hand, all the colorants used in the thermal transfer sheet comprise sublimable (or thermomigratory) dyes. Therefore, both systems are different from each other in color developing mechanism. This renders very difficult to select sublimable (or thermomigratory) dyes which match the three primary colors in the offset printing inks.

Furthermore, in the conventional dyes, when color images are formed using the three primary colors of cyan, magenta and yellow, it is very difficult to reproduce colors intermediate between these three colors. Thus, in order to provide a color image having a quality close to a printed image by the thermal transfer system, the development of a thermal transfer sheet capable of reproducing a wide variety of colors ranging from the three primary colors to colors intermediate between the three primary colors has been a very important technical task in the art.

SUMMARY OF THE INVENTION

An object of the present invention is to solve the above-described problems of the prior art and to provide a thermal transfer sheet which has a high heat sensitivity and can provide a full-color image having good color density and light fastness even in the case of application of a low thermal energy and, at the same time, can realize very excellent reproduction in a wide range of colors.

A further object of the present invention is to provide a thermal transfer sheet for the formation of a color image, which thermal transfer sheet can reproduce a hue close to that of SWOP (Specifications Web Offset Publications) color reference, Euro Color and the like known as a process ink suitable for printing correction applications.

The above objects can be attained by the following present invention. Specifically, the present invention provides a thermal transfer sheet for the formation of a color image, comprising a substrate sheet and, formed on one surface of said substrate sheet in a successive manner, dye layers of at least three colors of yellow, magenta and cyan respectively comprising dyes of three colors of yellow, magenta and cyan and resin binders for respective dyes, wherein said yellow dye is a dye represented by the following formulae (1) and/or (2), said magenta dye is at least one member selected from the group consisting of dyes represented by the following formulae (3) to (5) and said cyan dye is a dye represented by the following formulae (6) and/or (7):

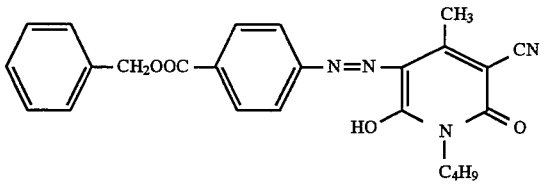

(1)

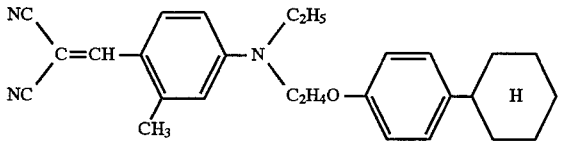

(2)

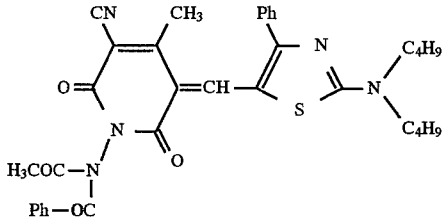

(3)

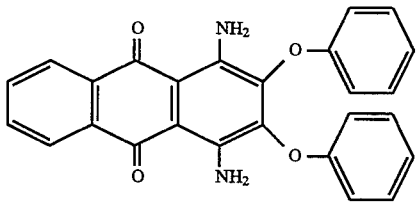

(4)

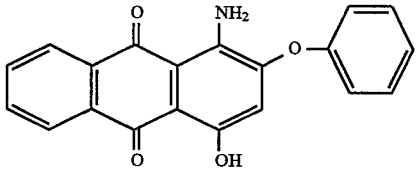

(5)

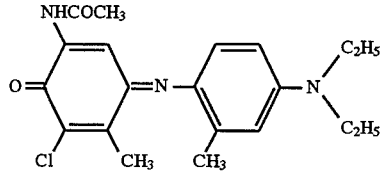

(6)

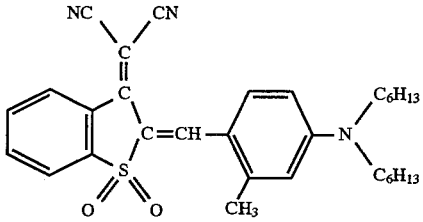

(7)

The formation of the dye layers of three colors in a successive manner on the surface of the substrate sheet using a combination of particular dyes of three colors can provide a thermal transfer sheet for the formation of a full-color image which has a high heat sensitivity and can provide a full-color image having good color density and light fastness even in the case of application of a low thermal energy and, at the same time, can realize very excellent reproduction in a wide range of colors.

BRIEF DESCRIPTION OF THE DRAWINGS

FIG. 1 is a perspective view showing the thermal transfer ribbon according to the present invention and a tray for housing the thermal transfer ribbon, wherein

FIG. 3 is a schematic diagram showing a thermal transfer ribbon loaded in a cassette attached to a printer, wherein

FIG. 4 is a perspective view showing the thermal transfer ribbon according to the present invention and a tray for housing the thermal transfer ribbon, wherein

FIG. 5 is a perspective view showing the thermal transfer ribbon according to the present invention and a tray for housing the thermal transfer ribbon, wherein

BEST MODE FOR CARRYING OUT THE INVENTION

Figure 1A:
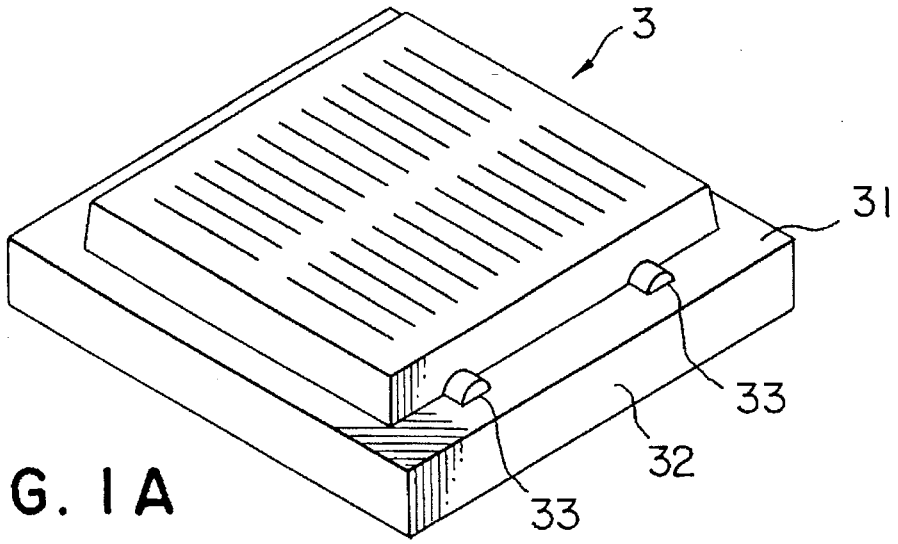
FIG. 1A is a schematic perspective view of a cover for a ribbon tray.

The present invention will now be described in more detail with reference to preferred embodiments.

A main feature of the present invention is that dye layers of three colors, that is, a yellow dye layer from a particular yellow dye, a magenta dye from a particular magenta dye and a cyan dye layer from a particular cyan dye, are successively formed on one surface of a substrate sheet to form a high-sensitivity thermal transfer sheet for the formation of a full-color image, which thermal transfer sheet has a high heat sensitivity and can provide a full-color image having good color density and light fastness even in the case of application of a low energy and, at that same time, can exhibit color reproduction equivalent or superior to the conventional offset printing.

The yellow dye used in the present invention is a dye represented by the formulae (1) and/or (2). These dyes may be used alone or in the form of a mixture. When they are used in the form of a mixture, the mixing ratio of the dye represented by the formula (1) to the dye represented by the formula (2) is preferably in the range of from 100:0 to 70:30 in terms of weight ratio. The magenta dye is at least one member selected from dyes represented by the formulae (3) to (5). These dyes may be used alone or in the form of a mixture. From the viewpoint of color reproduction, it is particularly preferred that the mixing ratio of the dye represented by the formula (3) to (the dye represented by the formula (4)+the dye represented by the formula (5)) be in the range of from 30:70 to 70:30 in terms of weight ratio.

The cyan dye is a dye represented by the formulae (6) and/or (7). These dyes may be used alone or in the form of a mixture. When they are used in the form of a mixture, the mixing ratio of the dye represented by the formula (6) to the dye represented by the formula (7) is preferably in the range of from 90:10 to 70:30 in terms of weight ratio. When the mixing ratio is outside the above-described range, the effect of improving the light fastness of a transferred image and the effect of improving the storage stability of the thermal transfer sheet are often unsatisfactory. Specifically, there sometimes occur unfavorable phenomena such as deposition of the dye and blocking during storage of the thermal transfer sheet in a roll form. A full-color image excellent particularly in color reproduction, color density and light fastness can be formed by using dyes of three colors in the above-described combination.

Further, according to the present invention, a thermal transfer sheet suitable for use in printing correction applications (proof) can be prepared by incorporating the dye represented by the formula (5) in the yellow dye layer or incorporating the dye represented by the formula (1) in the magenta dye layer or incorporating the dye represented by the formula (8) into the cyan dye layer.

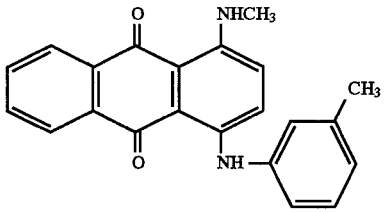

(8)

Specifically, as described above, a thermal transfer sheet, which has excellent weather resistance and storage stability (i.e., freedom from deposition of dye and blocking during storage of the thermal transfer sheet in a roll form) and a good color reproduction and, at the same time, can reproduce a hue close to that of SWOP (Specifications Web Offset Publications) color reference, Euro Color, etc. known as a process ink suitable for printing correction applications, can be preferably provided by incorporating the dye represented by the formulae (1) to (8) in a ratio as follows:

| |
|---|
| Yellow: |
| formula (1)/formula (2)/formula (5) = 1/0.01 to 0.5/0.03 to 0.15 |
| Magenta: |
| formula (3)/formula (4)/ formula (5)/formula (1) = 1/0.2 to 1.0/0.3 to 1.4/0.05 to 0.3 |
| Cyan: |
| formula (6)/formula (7)/formula (8) = 1/0.8 to 3.0/1.0 to 3.5 |

The binder resin for bearing dyes may be any of known binder resins, and examples thereof include cellulosic resins, such as ethyl cellulose, hydroxyethyl cellulose, hydroxypropyl cellulose, methyl cellulose and cellulose acetate, vinyl resins, such as polyvinyl alcohol, polyvinyl acetate, polyvinyl butyral, polyvinyl acetoacetal and polyvinyl pyrrolidone, acrylic resins, such as poly(meth)acrylates and poly(meth)acrylamides, polyurethane resins, polyamide resins and polyester resins. They may be used alone or in the form of a mixture of two or more of them.

Further, in the thermal transfer sheet of the present invention, it is particularly preferred for ethyl cellulose and/or a styrene/hydroxyethyl methacrylate/methyl methacrylate copolymer to be selected as a resin binder for each of the yellow dye layer and the magenta dye layer with ethyl cellulose being selected as a resin binder for the cyan dye layer. In this case, in the styrene/hydroxyethyl methacrylate/methyl methacrylate copolymer, the styrene/hydroxyethyl methacrylate/methyl methacrylate comonomer ratio is preferably in the range of from 1/0.01 to 1/0.1 to 10, particularly preferably in the range of from about 1/0.05 to 0.5/0.2 to 5, in terms of weight ratio from the viewpoint of the object of the present invention.

Use of a combination of the above-described binders with the above-described dyes contributes to an improvement in compatibility of the dyes with the binders, so that the resultant thermal transfer sheet has a high heat sensitivity and it becomes possible to provide an image having a good color density and an excellent light fastness.

The thermal transfer sheet of the present invention may have the same construction as the conventional thermal transfer sheet, except that dye layers of three primary colors are successively formed using a combination of particular dyes with particular resin binders. If necessary, a black dye layer may be additionally provided adjacently. The black dye may comprise a combination of dyes selected from the dyes represented by the formulae (1) to (8) according to the present invention or alternatively other dyes.

The substrate sheet used in the thermal transfer sheet of the present invention may be any known substrate sheet so far as it has certain heat resistance and strength. Examples of the substrate sheet usable in the present invention include paper, various types of converted paper, polyester film, polystyrene film, polypropylene film, polysulfone film, polycarbonate film, polyvinyl alcohol film and cellophane, these substrate sheets having a thickness of about 0.5 to 50 μm, preferably from 3 to 10 μm. Among them, the polyester film is particularly preferred.

Basically, the dye layers in the thermal transfer sheet of the present invention comprise the above-described materials. If necessary, they may further comprise various known additives commonly used in the art. In particular, the heat sensitivity of the resultant thermal transfer sheet can be markedly improved by incorporating in at least one of the dye layers dicyclohexyl phthalate in an amount of preferably about 0.1 to 50 parts by weight, particularly preferably about 0.5 to 30 parts by weight, based on 100 parts by weight of the resin binder. Further, fine particles of organic substances, such as polyethylene wax, or fine particles of inorganic substance may be incorporated in the dye layers for the purpose of regulating the coatability and preventing the thermal transfer sheet from fusing to an image-receiving sheet.

The above-described dye layers may be preferably formed by adding the above-described dyes, binder resins and other optional components to a suitable solvent to prepare solutions or dispersions as a coating solution or an ink for forming bearing layers, coating the surface of the above-described substrate sheet in a broad and continuous form with these coating solutions or inks for respective colors in a successive manner, for example, yellow, magenta and cyan in that order, in a desired width, for example, in a width in the range of from about 2 to 70 cm and drying each coating. Thereafter, the coated substrate sheet is cut into a suitable width and taken up in a roll form as a product.

The thickness of each dye layer thus formed is approximately in the range of from about 0.2 to 5.0 μm, preferably in the range of from about 0.4 to 2.0 μm. The content of the dye in the bearing layer is preferably in the range of from 5 to 70% by weight, still preferably in the range of from 10 to 60% by weight.

The thermal transfer sheet of the present invention, as such, is useful for thermal transfer purposes. It is also possible to provide an anti-blocking layer, that is, a release layer, on the surface of the dye layer. Provision of such a layer can prevent blocking between the thermal transfer sheet and the material to which an image is to be transferred in the stage of thermal transfer and enables a higher thermal transfer temperature to be used to form an image having a superior density.

Simple deposition of an anti-blocking inorganic powder exhibits a considerable effect as the release layer. It is also possible to form a release layer having a thickness in the range of from 0.01 to 5 μm, preferably in the range of from 0.05 to 2 μm, from a resin having an excellent releasing property, for example, a silicone polymer, an acrylic polymer or a fluoropolymer. It is noted that the above-described inorganic powder or releasing polymer can exhibit a satisfactory effect also when it is included in the dye layer.

Further, a heat resisting layer may be provide on the reverse surface of the thermal transfer sheet for the purpose of preventing an adverse effect of heat from the thermal head on the thermal transfer sheet. For example, the heat resisting layer may comprise a layer comprising a reaction product of polyvinyl butyral with an isocyanate compound, a surfactant, such as an alkali metal salt or an alkaline earth metal salt of a phosphate and a filler, such as talc.

The material, to which an image is to be transferred, used for forming an image using the thermal transfer sheet may be any material so far as the recording surface is receptive to the above-described dyes. If materials having no receptivity to the dyes, such as paper, metals, glass and synthetic resins, are used, a dye-receiving layer may be formed on at least one surface of such materials.

Examples of the material which can be used without forming a dye-receiving layer include fibers, woven fibers, films, sheets, moldings and other forms of polyolefin resins, such as polyethylene and polypropylene, halogenated polymers, such as polyvinyl chloride and polyvinylidene chloride, vinyl polymers, such as polyvinyl acetate and polyacrylic esters, polyester resins, such as polyethylene terephthalate, polybutylene terephthalate, polystyrene resins, polyamide resins, resins of copolymers of olefins, such as ethylene or propylene with other vinyl monomers, ionomers, cellulosic resins, such as cellulose diacetate, cellulose triacetate, polycarbonates, polysulfones and polyimides.

Particularly preferred are polyester sheets or films and converted paper provided with a polyester layer. Even though the material intended to be used as a material, to which an image is to be transferred, is paper, a metal, glass or other non-dyeable materials, a solution or a dispersion of the above-described dyeable resin may be coated on the recording surface and dried to form a coating or alternatively the dyeable resin film may be laminated on the recording surface, thereby rendering the non-dyeable material useable as a material to which an image is to be transferred.

Further, also when the material intended to be used as a material, to which an image is to be transferred, is dyeable, it is also possible to form on the surface thereof a dye-receiving layer using a resin having a better dyeability in the same manner as that described above in connection with use of paper.

The dye-receiving layer prepared as described above may comprise a single material or a plurality of materials and may further comprise various additives so far as these additives are not detrimental to the desired end.

Although the dye-receiving layer may have any desired thickness, the thickness is generally in the range of from 3 to 50 μm. Further, the dye-receiving layer is preferably in the form of a continuous coating. However, it may be in the form of a discontinuous coating formed by using a resin emulsion or a resin dispersion.

The material, to which an image is to be transferred, basically has the above-described construction and, as such, can sufficiently attain the desired end. It is also possible to incorporate an anti-blocking inorganic powder in the material, to which an image is to be transferred, or the dye-receiving layer. The incorporation of the anti-blocking inorganic powder can prevent blocking between the thermal transfer sheet and the material, to which an image is to be transferred, even when the thermal transfer temperature is raised, so that superior thermal transfer can be carried out. Finely divided silica is particularly preferred.

The above-described resin having a good releasing property may be added instead of or in combination with the inorganic powder of silica or the like. Particularly preferred examples of the releasing polymer include a cured product of a silicone compound, for example, a cured product comprising an epoxy-modified silicone oil and an amino-modified silicone oil. It is preferred for the releasing agent to occupy about 0.5 to 30% by weight of the weight of the dye-receiving layer.

The above-described inorganic powder may be adhered onto the surface of the dye-receiving layer in the material to which an image is to be transferred for the purpose of enhancing the anti-blocking effect. Further, it is also possible to provide a layer comprising the above-described releasing agent having an excellent releasing property.

In the release layer, a thickness in the range of from about 0.01 to 5 μm suffices for attaining a satisfactory effect, that is, attaining a further improvement in receptivity to dye while preventing blocking between the thermal transfer sheet and the dye-receiving layer.

Means for applying a thermal energy at the time of the thermal transfer using the above-described thermal transfer sheet of the present invention and the above-described recording material may be any means known in the art. For example, the desired end can be sufficiently attained by applying a thermal energy of about 5 to 30 $mJ/mm^2$ through the control of a recording time by means of a recording device, for example, a thermal printer (for example, a video printer VY-100 manufactured by Hitachi, Limited).

Preferred embodiments of a tray for loading the thermal transfer sheet for forming a color image according to the present invention in a printer will now be described. In the following description, the thermal transfer sheet will be referred to also as a "thermal transfer ribbon" according to the common usage in the art.

In order to facilitate loading of the thermal transfer ribbon in a thermal transfer printer, a supply bobbin for unrolling the thermal transfer ribbon and a bobbin for rolling the thermal transfer sheet have hitherto been housed in a cassette case with a good dimensional accuracy designed for the printer.

In the storage after production, the delivery from a factory and the distribution, the above-described cassette cases for the thermal transfer ribbon have been individually hermetically sealed in a plastic film combined with an aluminum foil having excellent lightproofness and moistureproofness in order to protect the thermal transfer ribbons and further put into a fancy box and packaged in a corrugated board.

Figure 2:
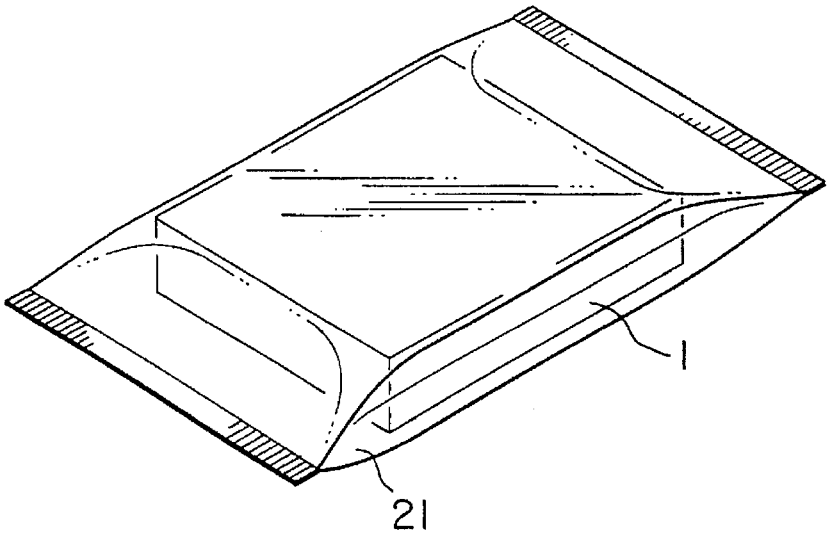
FIG. 2 is a diagram showing a tray which houses a thermal transfer ribbon therein and is hermetically sealed in an internal bag.

The conventional cassette case containing a thermal transfer ribbon is discarded after use without reuse. Further, the cassette case required to have good quality and accuracy is unfavorably prepared by forming at a high cost including the cost of the mold. Furthermore, since the size of the cassette case is larger than the volume accounted for by the thermal transfer ribbon, when it is bagged by pillow type packaging as shown in FIG. 2, the quantity of the composite packaging material used is large and the package is bulky, so that the fancy box, corrugated board, etc. should have a large size.

According to an embodiment of the present invention, a tray for a thermal transfer ribbon, which can be simply packaged and is excellent in storage and distribution, is provided by constructing a tray so as for a supplied thermal transfer ribbon to be loaded directly in a printer without housing the thermal transfer ribbon in the expensive cassette case for supplying the thermal transfer ribbon to the printer.

Specifically, the ribbon tray according to this embodiment is a plastic ribbon tray for housing a thermal transfer ribbon constructed so as to incorporate a thermal transfer ribbon supply bobbin and a bobbin for rolling the thermal transfer sheet after use in the transfer and to be loaded in a printer directly or through a cassette attached to the printer, wherein a stopper corresponding to slip preventive portions formed in the ribbon bobbins is provided in a tray body and/or a cover to form a mechanism for preventing the roll from loosening.

In the ribbon tray according to the present embodiment, stoppers having shapes corresponding to a slip preventive portion provided in a ribbon supply bobbin and a ribbon rolling bobbin in the thermal transfer ribbon are provided. The thermal transfer ribbon, which has been housed in the ribbon tray and put into an internal bag, is free from loosening of the roll caused by slip of the bobbin and packaged without including the cassette case having a large volume, which contributes to a reduction in packaging material, storage and distribution costs and quantity of wastes.

Figure 1B:
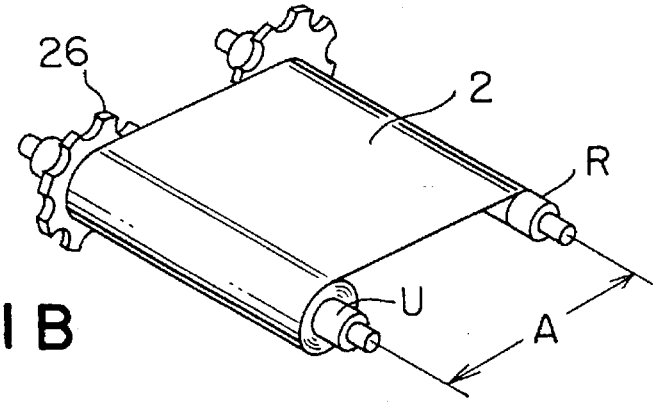
FIG. 1B is a schematic perspective view of a thermal transfer ribbon and FIG. 1C is a schematic perspective view of a ribbon tray.
Figure 1C:
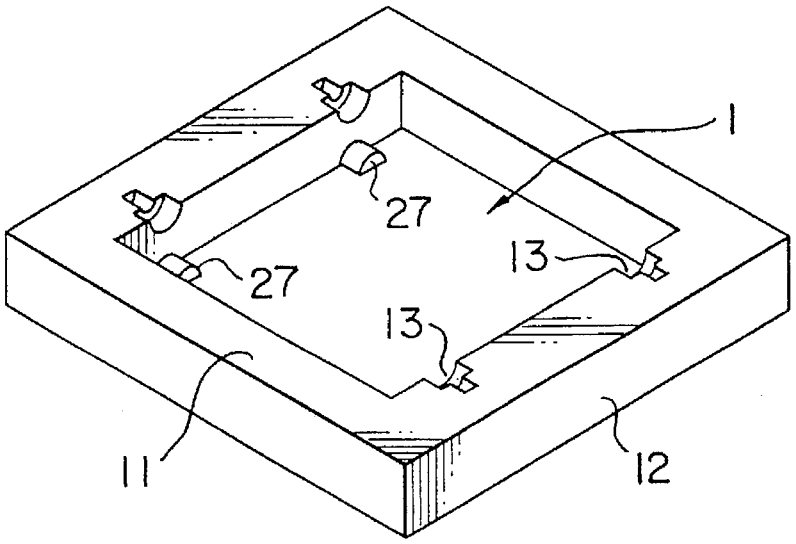

As shown in FIGS. 1A to 1C, one of preferred embodiments of the ribbon tray 1 comprises: a tray body 1 provided with a stopper 27 having an uneven shape corresponding to that of an uneven sprocket 26 provided in bobbins for a thermal transfer ribbon 2; and a cover 3. The ribbon tray can be prepared by the conventional pressure forming or vacuum forming of plastics.

It is also possible to use a plug assist for the purpose of exactly forming the uneven portions provided in the tray.

Examples of the plastic sheet used in the forming of the tray body 1 include polystyrene, polypropylene, polyvinyl chloride, ABS resin, polycarbonates, polymethyl methacrylate, polyesters, ethylene/acrylic acid copolymer, ethylene/acrylic ester copolymer and ionomers in the form of sheets or composites thereof, and a polystyrene sheet is preferred.

Loading of these formable materials with inorganic materials, such as calcium carbonate, talc and clay, reduces the quantity of heat during incineration, and addition of edible substances, such as starch, renders the plastic sheet biodegradable.

Although the sheet thickness is determined depending upon the inherent strength of the sheet, the size of the thermal transfer ribbon and the weight, it is preferably in the range of from 0.4 to 1.2 mm.

The tray prepared by forming has a shape shown in FIGS. 1A to 1C and a size suitable for exactly housing the thermal transfer ribbon.

In the tray, a shaft-receiving portion 13 in an arc form corresponding to rounding of the bobbin, around which the thermal transfer ribbon is rolled, is formed on the side wall in the longitudinal direction of the bobbin. A horizontal portion is provided in the periphery of the upper portion in the tray body 1, and a folded portion 12 is provided continuously with the horizontal portion 11. The formed product has a shape so that it can be stamped out at the end of the folded portion. It is possible to provide a protrusion or a recess (not shown) on any desired side of the horizontal portion 11 so that the tray body and the cover are fixed to each other by fitting.

In a preferred embodiment, the bottom of the tray is provided with a stopper 27 which prevents slipping of bobbins through fitting in the recess of an uneven sprocket 26 provided in a supply bobbin U and a rolling bobbin R in the thermal transfer ribbon 2.

The uneven sprocket 26 serving as a mechanism for preventing the roll from loosening may be provided at any place other than the sliding portion in the site inserted into the printer.

Further, the uneven form serving as the mechanism for preventing the roll from loosening is not limited o the sprocket form and may be any uneven form so far as it can be fitted in the uneven form provided in the tray to prevent the bobbin from slipping. For example, it may be radial or cross.

The slip preventing portion formed in the bobbin is not limited to those constructed from particular members, such as a sprocket 26, and as shown in FIGS. 4A, 4B, 5A and 5B, the shaft of the bobbin may be constructed in a polygonal form (preferably triangular, quadrangular, pentagonal or hexagonal form).

In this case, also the stopper provided in the tray body and/or the cover is constructed by bringing the shaft-receiving portion of the bobbin to a shape corresponding to the polygonal shape of the shaft.

Figure 3A:
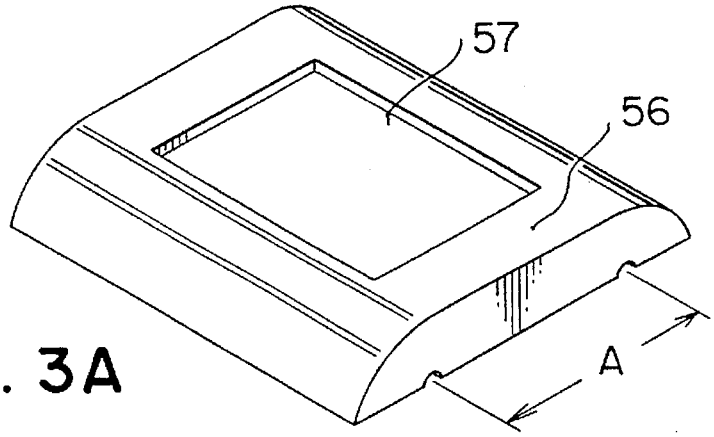
FIG. 3A is a perspective view of a cover for a cassette and FIG. 3B is a diagram showing a thermal transfer ribbon which has been loaded in a cassette body.
Figure 3B:
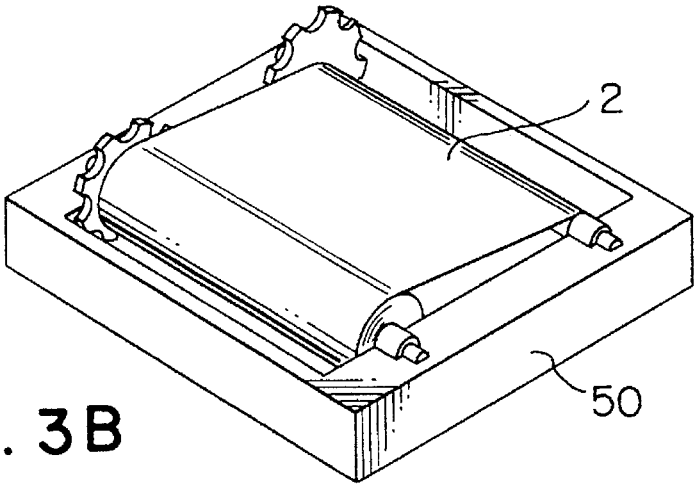
Figure 4A:
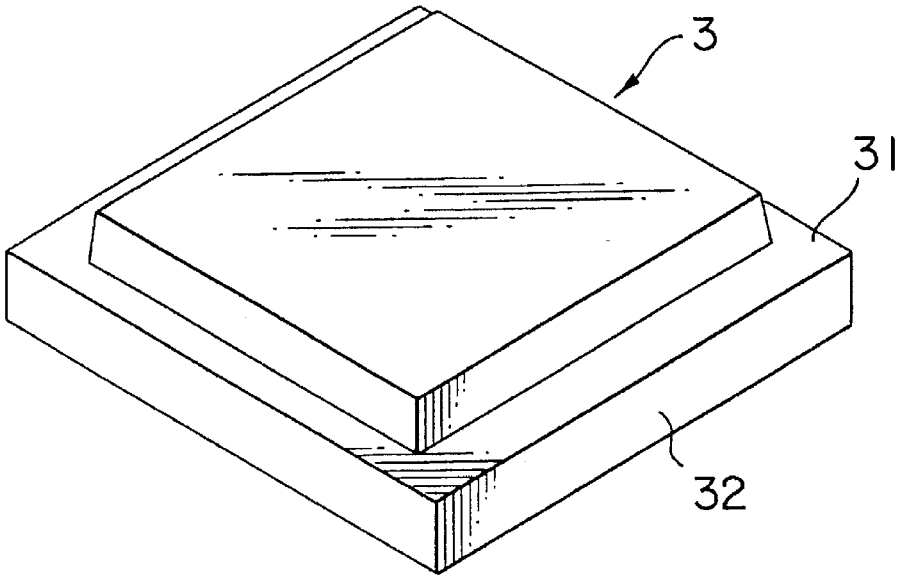
FIG. 4A is a schematic perspective view of a cover for a ribbon tray and FIG. 4B is a schematic view of a thermal transfer ribbon and a ribbon tray.
Figure 4B:
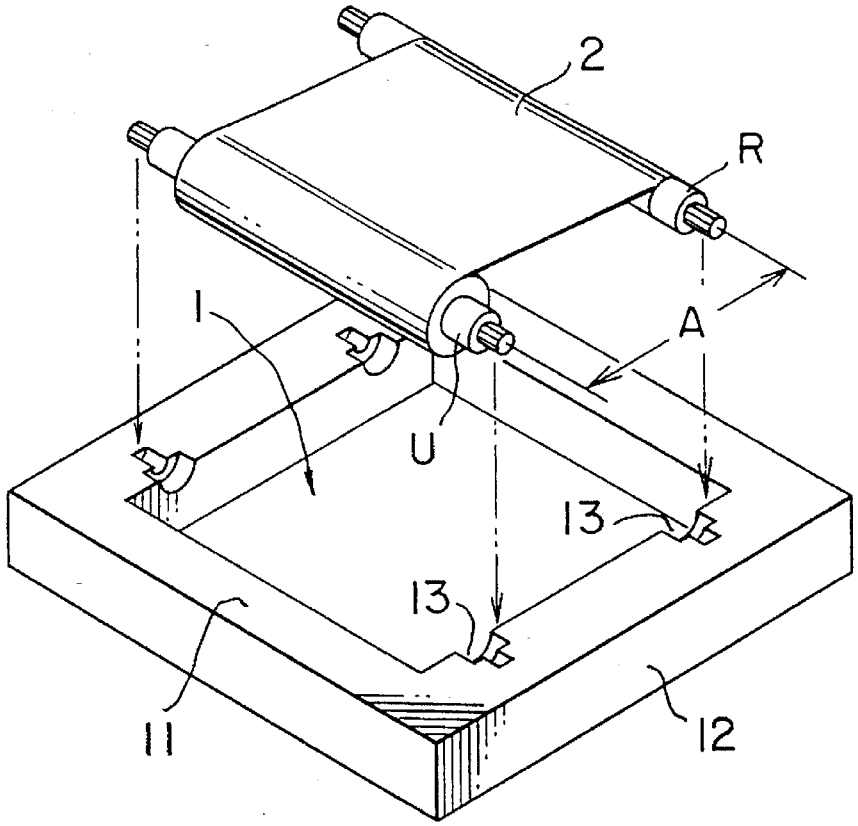
Figure 5A:
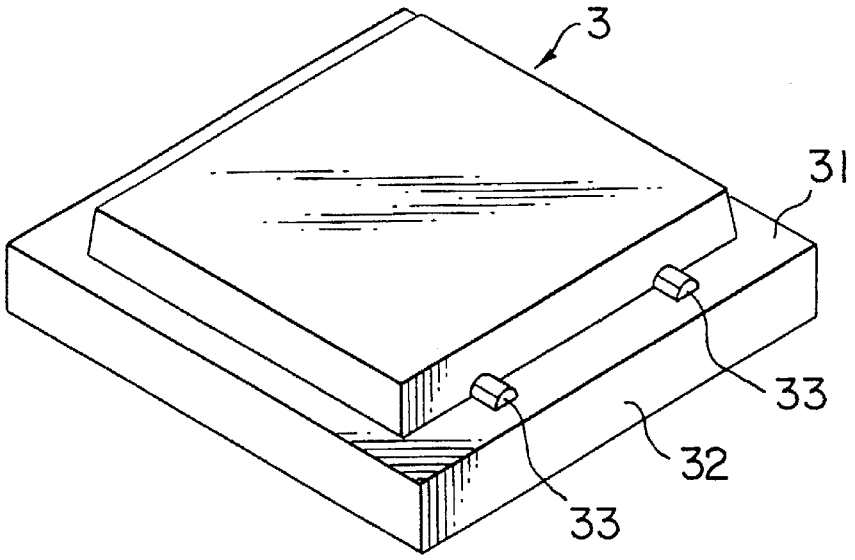
FIG. 5A is a schematic perspective view of a cover for a ribbon tray and FIG. 5B is a schematic view of a thermal transfer ribbon and a ribbon tray.
Figure 5B:
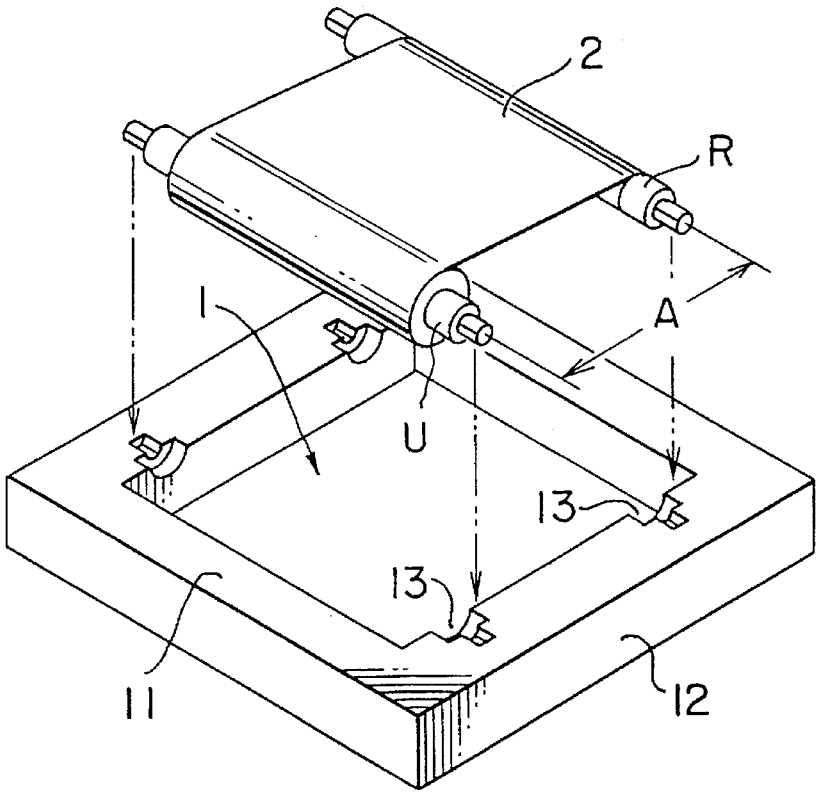

The distance A between the two bobbins provided in the tray is preferably conformed to the distance between the sites of the ribbon cassette of the printer in which the two bobbins are loaded when the thermal transfer ribbon of the present invention is loaded in the printer. The thermal transfer ribbon constructed as described above can be taken out of an internal bag 21 as shown in FIG. 2, in which the thermal transfer ribbon has been hermetically sealed, and, after removal of the cover 3, loaded from the ribbon tray of the present invention directly in a printer or alternatively a ribbon cassette 50 attached to a printer as shown in FIGS. 3A and 3B. In this case, since the distance between the bobbins is not varied, even a thermal transfer ribbon comprising a thin film having a thickness of 3 to 10 μm can be easily loaded without occurrence of cockle.

The transfer of the colorant is carried out through an opening 57 provided in a cover 56 of the cassette.

The distance A between the two bobbins need not be necessarily conformed to that necessary for that loaded in the cassette of the printer. If the distance between the two bobbins can be increased to the distance A, which the printer requires, and loading can be successfully carried out without occurrence of any cockle of the film, the distance between the bobbins can be brought unlimitedly close to 0 (zero).

A reduction in the distance between the bobbins means that the size of the tray can be reduced to a width necessary for the diameters of the bobbins. For example, the following technique may be adopted. Specifically, the tray body and the cover may be constructed from two parallel movable parts, the ribbon is housed in the tray body with a small distance between the bobbins, and the tray body and the cover are moved parallel to increase the distance between the bobbins to the distance between the sites of the ribbon cassette of the printer in which the two bobbins are loaded.

This can reduce the size of the formable sheet, internal bag, fancy box and corrugated box, which can contribute greatly to a reduction in overall distribution cost including packaging cost, storehouse cost and cost of transportation.

Figure 6:
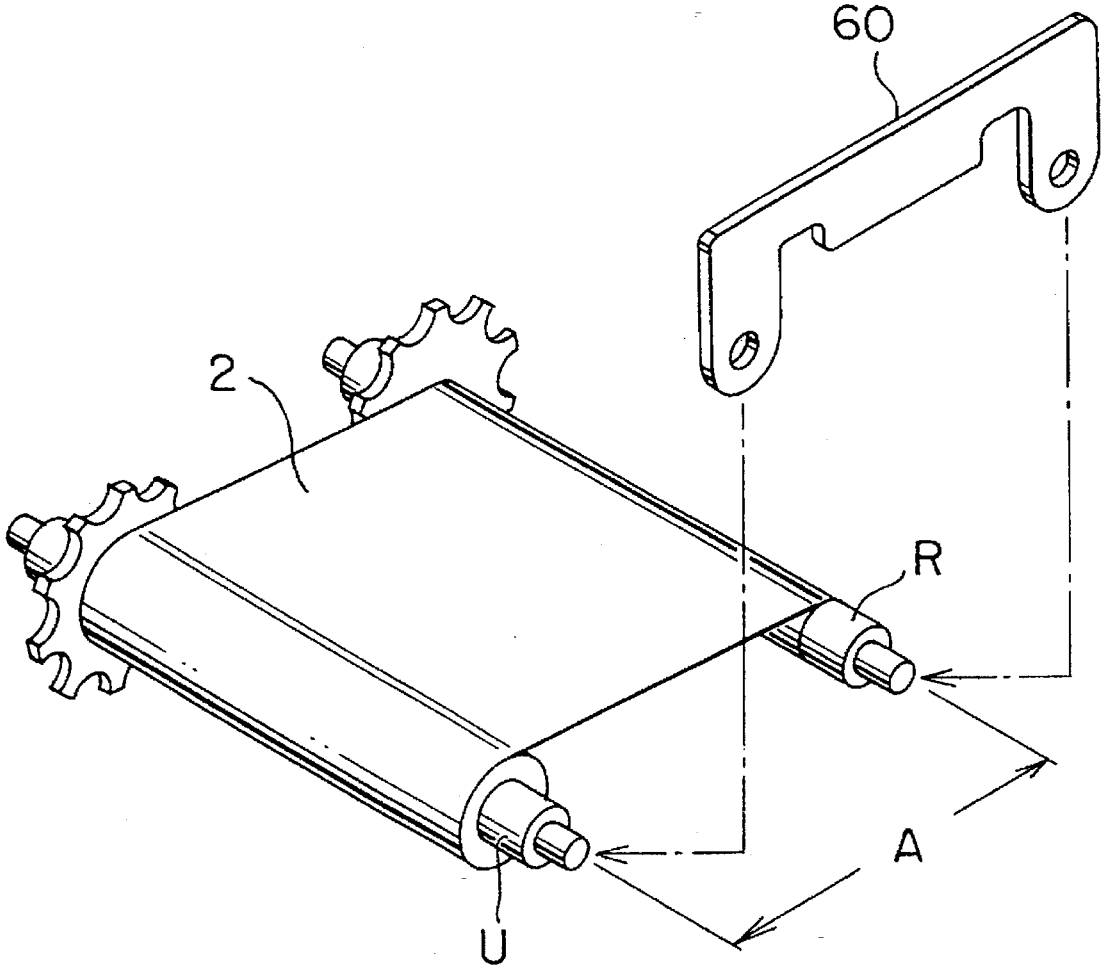
FIG. 6 is a perspective view of a thermal transfer ribbon according to the present invention.

In the rolling bobbin and the supply bobbin housed in the ribbon tray according to the present embodiment, as shown in FIG. 6, these bobbins are fixed by a fixing member 60 which fixes the bobbins according to the housing distance of the ribbon tray. In this case, the material for the fixing member is not particularly limited, and examples thereof include metals, plastics and paper. The fixing member serves to fix both the bobbins at a predetermined distance, thereby preventing the roll from loosening, and, at the same time, to facilitate carrying when the thermal transfer ribbon is loaded in a printer or a cassette from the ribbon tray.

Further, the fixing member serves also as a ROM discrimination mechanism for the printer by varying the shape of the member or putting a desired mark on the member. For example, as shown in FIG. 6, types of the ribbons (for example, standard ribbons and ribbons for OHP) can be distinguished according to the shape, size, position and other factors of a protrusion provided at the center of the fixing member, and according to the information, printing conditions of the printer, types of the material to which an image is to be transferred, etc. can be properly varied.

The cover 3 is prepared by vacuum forming or pressure forming into a shape as shown in FIG. 1 using the same material as the tray body. In this case, the periphery of the cover has such a shape that the periphery of the cover and the outer periphery 12 of the tray body are fitted in each other. The center portion of the cover has an uneven shape 33 corresponding to the roundness of the bobbin used in the thermal transfer ribbon to be housed in the center portion of the cover. A folded portion 32 is formed outward continuously with the horizontal portion 31 of the periphery of the cover, and the end of the folded portion is stamped out after forming.

A recess or a protrusion (not shown) corresponding to a protrusion or a recess for fitting-fixation provided in the horizontal portion 11 of the tray body can be provided in the horizontal portion 31 in the periphery of the cover. A member corresponding to a slip preventive stopper, which is fitted in the recess of the uneven sprocket 26 provided in the supply bobbin U and the rolling bobbin R in the thermal transfer ribbon 2 is preferably provided also in the cover.

The cover 3 is provided when no bagging is carried out, the periphery of the thermal transfer ribbon is protruded on the upper part of the tray or the frequency of removal of the thermal transfer sheet in the printer is high. Therefore, the cover 3 is not necessarily needed in the present invention. When the cover 3 is not provided, the thermal transfer ribbon housed in the ribbon tray body 1 is directly hermetically housed in an internal bag film and packaged in a fancy box.

The cover and/or the bottom face of the ribbon tray body are preferably provided with a slip preventive mechanism.

The slip preventive mechanism serves to prevent occurrence of vibration caused by side slipping of the ribbon tray per se, which vibration is one of the causes of loosening of the ribbon roll. The slip preventive mechanism can be provided by surface treatment of the bottom face of the ribbon tray body and/or the surface of the cover, such as coating of a filler-loaded resin layer in the stage of forming of the tray or provision of uneven surface by forming.

As described above, the thermal transfer sheet of the present invention is housed and packaged in a ribbon tray in such a state as will be loaded in a printer, gives rise to no problem of storage, such as loosening of the roll, even after storage and distribution and can be loaded in a printer or a cassette attached to a printer. As opposed to the conventional thermal transfer ribbon supplied after housing in a cassette, in the thermal transfer sheet of the present invention, there is no need of discarding the expensive cassette after use, which contributes greatly to saving of resource and a reduction in distribution cost.

The present invention will now be described in more detail with reference to the following Examples and Comparative Examples. In the following Examples and Comparative Examples, "parts" or "%" is by weight unless otherwise specified.

EXAMPLE 1

Ink compositions comprising the following components for the formation of dye layers of three colors were prepared and each coated on the surface of a 6 μm-thick polyethylene terephthalate film subjected to a treatment for rendering the back surface heat-resistant at a coverage of 1.0 g/m$^2$ on a dry basis and then dried to provide a thermal transfer sheet for a full-color image according to the present invention.

| | |
|---|---|
| Yellow color | |
| Dye of the formula (1) | 3.0 parts |
| Dye of the formula (2) | 0.5 part |
| Polyvinylacetoacetal resin (KS-5 manufactured by Sekisui Chemical Co., Ltd.) | 3.5 parts |
| Methyl ethyl ketone | 46.2 parts |
| Toluene | 46.2 parts |
| Polyethylene wax | 0.05 part |
| Magenta color | |
| Dye of the formula (3) | 4.0 parts |
| Dye of the formula (4) | 2.0 parts |
| Dye of the formula (5) | 2.0 parts |
| Polyvinylacetoacetal resin (KS-5 manufactured by Sekisui Chemical Co., Ltd.) | 3.5 parts |
| Methyl ethyl ketone | 44.2 parts |
| Toluene | 44.2 parts |
| Polyethylene wax | 0.07 part |
| Cyan color | |
| Dye of the formula (6) | 3.6 parts |
| Dye of the formula (7) | 0.4 part |
| Polyvinylacetoacetal resin (KS-5 manufactured by Sekisui Chemical Co., Ltd.) | 3.5 parts |
| Methyl ethyl ketone | 46.2 parts |
| Toluene | 46.2 parts |
| Polyethylene wax | 0.05 part |

Synthetic paper (Yupo-FPG#150 manufactured by Oji-Yuka Synthetic Paper Co., Ltd.) was used as a substrate sheet, and a coating solution having the following composition was coated on one surface of the synthetic paper so that the coverage on a dry basis was 10.0 g/m$^2$, and the resultant coating was dried at 100° C. for 30 min, thereby providing a material to which an image is to be transferred.

| | |
|---|---|
| Polyester resin (Vylon 200 manufactured by Toyobo Co., Ltd.) | 11.5 parts |
| Vinyl chloride/vinyl acetate copolymer (VYHH manufactured by UCC) | 5.0 parts |
| Amino-modified silicone (KF-393 manufactured by The Shin-Etsu Chemical Co., Ltd.) | 1.2 parts |
| Epoxy-modified silicone (X-22-343 manufactured by The Shin-Etsu Chemical Co., Ltd.) | 1.2 parts |
| Methyl ethyl ketone/toluene/cyclohexanone (weight ratio = 4:4:2) | 102.0 parts |

EXAMPLES 2 to 14

Thermal transfer sheets for a full-color image according to the present invention were prepared in the same manner as that of Example 1, except that dyes and resin binders specified in the following Table 1 were used.

TABLE 1

| Examples | Color | Dye | Resin binder |
|---|---|---|---|
| 2 | Y | Dye of formula (1): 3.0 parts | Polyvinylacetoacetal resin: 3.5 parts |
| | M | Dye of formula (3): 2.0 parts<br>Dye of formula (4): 2.0 parts<br>Dye of formula (5): 2.0 parts | Polyvinylacetoacetal resin: 3.5 parts |
| | C | Dye of formula (6): 3.6 parts<br>Dye of formula (7): 0.4 part | Polyvinylacetoacetal resin: 3.5 parts |
| 3 | Y | Dye of formula (1): 3.0 parts | Polyvinylacetoacetal resin: 3.5 parts |
| | M | Dye of formula (3): 4.0 parts<br>Dye of formula (4): 2.0 parts<br>Dye of formula (5): 1.0 part | Polyvinylacetoacetal resin: 3.5 parts |
| | C | Dye of formula (6): 3.2 parts<br>Dye of formula (7): 0.8 part | Polyvinylacetoacetal resin: 3.5 parts |
| 4 | Y | Dye of formula (1): 3.0 parts<br>Dye of formula (2): 0.5 part | Polyvinylacetoacetal resin: 3.5 parts<br>Polyvinylacetoacetal resin: 3.5 parts |
| | M | Dye of formula (3): 4.0 parts<br>Dye of formula (4): 1.0 part<br>Dye of formula (5): 2.0 parts | Polyvinylacetoacetal resin: 3.5 parts |
| | C | Dye of formula (6): 3.6 parts<br>Dye of formula (7): 0.4 part | Polyvinylacetoacetal resin: 3.5 parts |
| 5 | Y | Dye of formula (1): 3.0 parts<br>Dye of formula (2): 0.5 part | Polyvinylacetoacetal resin: 3.5 parts |
| | M | Dye of formula (3): 3.0 parts<br>Dye of formula (4): 2.0 parts<br>Dye of formula (5): 2.0 parts | Polyvinylacetoacetal resin: 3.5 parts |
| | C | Dye of formula (6): 3.0 parts<br>Dye of formula (7): 1.0 part | Polyvinylacetoacetal resin: 3.5 parts |
| 6 | Y | Dye of formula (1): 3.0 parts<br>Dye of formula (2): 1.0 part | Polyvinylacetoacetal resin: 3.5 parts |
| | M | Dye of formula (3): 2.0 parts<br>Dye of formula (4): 2.0 parts<br>Dye of formula (5): 2.0 parts | Polyvinylacetoacetal resin: 3.5 parts |
| | C | Dye of formula (6): 3.2 parts<br>Dye of formula (7): 0.5 part | Polyvinylacetoacetal resin: 3.5 parts |
| 7 | Y | Dye of formula (1): 3.0 parts<br>Dye of formula (2): 1.0 part | Polyvinylacetoacetal resin: 3.5 parts<br>Polyvinylacetoacetal resin: 3.5 parts |
| | M | Dye of formula (3): 4.0 parts<br>Dye of formula (4): 1.0 part<br>Dye of formula (5): 1.0 part | Polyvinylacetoacetal resin: 3.5 parts |
| | C | Dye of formula (6): 3.4 parts<br>Dye of formula (7): 0.6 part | Polyvinylacetoacetal resin: 3.5 parts |
| 8 | Y | Dye of formula (1): 3.0 parts<br>Dye of formula (2): 0.5 part | Ethyl cellulose: 4.0 parts |
| | M | Dye of formula (3): 4.0 parts<br>Dye of formula (4): 2.0 parts<br>Dye of formula (5): 2.0 parts | Ethyl cellulose: 4.0 parts |
| | C | Dye of formula (6): 3.6 parts<br>Dye of formula (7): 0.4 part | Ethyl cellulose: 4.0 parts |
| 9 | Y | Dye of formula (1): 3.0 parts<br>Dye of formula (2): 0.5 part | Polystyrene: 3.5 parts |
| | M | Dye of formula (3): 4.0 parts<br>Dye of formula (4): 1.0 part | Polymethyl methacrylate: 3.5 parts |
| | C | Dye of formula (6): 2.5 parts<br>Dye of formula (7): 2.0 parts | Acrylonitrile/styrene copolymer: 3.5 parts |
| 10 | Y | Dye of formula (2): 3.0 parts | Polyvinylacetoacetal resin: 3.5 parts |
| | M | Dye of formula (4): 2.0 parts<br>Dye of formula (5): 2.0 parts | Polyvinylacetoacetal resin: 3.5 parts |
| | C | Dye of formula (6): 1.0 part<br>Dye of formula (7): 3.0 parts | Polyvinylacetoacetal resin: 3.5 parts |
| 11 | Y | Dye of formula (1): 1.0 part<br>Dye of formula (2): 2.0 parts | Polyvinylacetoacetal resin: 3.5 parts |
| | M | Dye of formula (3): 1.0 part<br>Dye of formula (4): 2.0 parts<br>Dye of formula (5): 2.0 parts | Polyvinylacetoacetal resin: 3.5 parts |

TABLE 1-continued

| Examples | Color | Dye | Resin binder |
|---|---|---|---|
| | C | Dye of formula (6): 1.0 part Dye of formula (7): 2.5 parts | Polyvinylacetoacetal resin: 3.5 parts |
| 12 | Y | Dye of formula (1): 2.0 parts Dye of formula (2): 1.5 parts | Polyvinylacetoacetal resin: 3.5 parts |
| | M | Dye of formula (3): 4.0 parts Dye of formula (5): 1.0 part | Polyvinylacetoacetal resin: 3.5 parts |
| | C | Dye of formula (6): 1.5 parts Dye of formula (7): 1.5 parts | Polyvinylacetoacetal resin: 3.5 parts |
| 13 | Y | Dye of formula (1): 3.0 parts Dye of formula (2): 0.7 part | Polyvinylacetoacetal resin: 3.5 parts |
| | M | Dye of formula (3): 4.0 parts Dye of formula (4): 2.0 parts Dye of formula (5): 2.0 parts | Polyvinylacetoacetal resin: 3.5 parts |
| | C | Dye of formula (6): 3.5 parts Dye of formula (7): 1.0 part | Polyvinylacetoacetal resin: 3.5 parts |
| 14 | Y | Dye of formula (1): 3.0 parts Dye of formula (2): 0.5 parts | Polyvinylacetoacetal resin: 3.2 parts |
| | M | Dye of formula (3): 3.3 parts Dye of formula (4): 0.6 part Dye of formula (5): 2.2 parts | Polyvinylacetoacetal resin: 3.6 parts |
| | C | Dye of formula (6): 2.2 parts Dye of formula (7): 0.6 part | Polyvinylacetoacetal resin: 3.6 parts |

Each of the above-described thermal transfer sheets of the present invention and the above-described material to which an image is to be transferred were put on top of the other in such a manner that the dye layer and the dye-receiving surface faced each other. Recording was carried out by means of a thermal head from the back surface of the thermal transfer sheet under conditions of a head applied voltage of 17.0 V and a printing time of 8.0 msec/line to provide full-color images comprising three primary colors. The density and light fastness of the three color components at shadow portions of these images were evaluated, and the results were as given in Table 2.

TABLE 2

| Examples | Color | Image density | Light fastness |
|---|---|---|---|
| 1 | Y | 2.41 | ◎ |
| | M | 2.52 | ◎ |
| | C | 2.37 | ◎ |
| 2 | Y | 2.35 | ◎ |
| | M | 2.38 | ◎ |
| | C | 2.37 | ◎ |
| 3 | Y | 2.35 | ◎ |
| | M | 2.43 | ◎ |
| | C | 2.43 | ◎ |

TABLE 2-continued

| Examples | Color | Image density | Light fastness |
|---|---|---|---|
| 4 | Y | 2.41 | ◎ |
| | M | 2.41 | ◎ |
| | C | 2.37 | ◎ |
| 5 | Y | 2.41 | ◎ |
| | M | 2.36 | ◎ |
| | C | 2.45 | ◎ |
| 6 | Y | 2.48 | ◎ |
| | M | 2.38 | ◎ |
| | C | 2.41 | ◎ |
| 7 | Y | 2.48 | ◎ |
| | M | 2.36 | ◎ |
| | C | 2.38 | ◎ |
| 8 | Y | 2.28 | ◎ |
| | M | 2.54 | ◎ |
| | C | 2.43 | ◎ |
| 9 | Y | 1.85 | ◎ |
| | M | 1.90 | ○ |
| | C | 1.73 | ○ |
| 10 | Y | 2.34 | ◎ |
| | M | 1.53 | ◎ |
| | C | 2.38 | Δ |
| 11 | Y | 2.28 | ○ |
| | M | 2.15 | ◎ |
| | C | 2.33 | ○ |
| 12 | Y | 2.34 | Δ |
| | M | 2.14 | ○ |
| | C | 2.30 | ○ |
| 13 | Y | 2.45 | ◎ |
| | M | 2.45 | ◎ |
| | C | 2.48 | ◎ |
| 14 | Y | 2.48 | ◎ |
| | M | 2.35 | ◎ |
| | C | 2.30 | ◎ |

◎: very good
○: good
Δ: fair

The results of the evaluation of the light fastness are based on relative evaluation of the light fastness of the images in Examples 1 to 14.

EXAMPLE 15

Ink compositions comprising the following components for the formation of dye layers of three colors were prepared and each coated on the surface of a polyethylene terephthalate film having a width of 20 cm and a thickness of 6 μm subjected to a treatment for rendering the back surface of the film heat-resistant at a coverage of 1.0 g/m$^2$ on a dry basis in a width of 15 cm in a direction perpendicular to the longitudinal direction of the film and then dried. Then, the coat film was cut in a width of 10 cm in the longitudinal direction of the film and taken up in a roll form to provide the thermal transfer sheet for a full-color image according to the present invention.

| | |
|---|---|
| Yellow color | |
| Dye of the formula (1) | 3.00 parts |
| Ethyl cellulose | 3.20 parts |
| Dicyclohexyl phthalate | 0.016 part |
| Methyl ethyl ketone | 55.00 parts |
| Toluene | 34.70 parts |
| Microfine MF8F (manufactured by ASTOR Wax) | 0.06 part |
| Magenta color | |
| Dye of the formula (3) | 4.50 parts |
| Dicyclohexyl phthalate | 0.96 part |
| Ethyl cellulose | 3.20 parts |

-continued

| | |
|---|---|
| Methyl ethyl ketone | 44.85 parts |
| Toluene | 44.85 parts |
| Microfine MF8F | 0.12 part |
| Cyan color | |
| Dye of the formula (6) | 3.50 parts |
| Dicyclohexyl phthalate | 0.15 part |
| Ethyl cellulose | 3.20 parts |
| Methyl ethyl ketone | 29.44 parts |
| Toluene | 43.84 parts |
| Methyl isobutyl ketone | 10.00 parts |
| Microfine MF8F | 0.18 part |

Synthetic paper (Yupo-FPG#150 manufactured by Oji-Yuka Synthetic Paper Co., Ltd.) was used as a substrate sheet, and a coating solution having the following composition was coated on one surface of the synthetic paper so that the coverage on a dry basis was 10.0 g/m$^2$, and the resultant coating was dried at 100° C. for 30 min, thereby providing a material to which an image is to be transferred.

| | |
|---|---|
| Polyester resin (Vylon 200 manufactured by Toyobo Co., Ltd.) | 11.5 parts |
| Vinyl chloride/vinyl acetate copolymer (VYHH manufactured by UCC) | 5.0 parts |
| Amino-modified silicone (KF-393 manufactured by The Shin-Etsu Chemical Co., Ltd.) | 1.2 parts |
| Epoxy-modified silicone (X-22-343 manufactured by The Shin-Etsu Chemical Co., Ltd.) | 1.2 parts |
| Methyl ethyl ketone/toluene/cyclohexanone (weight ratio = 4:4:2) | 102.0 parts |

EXAMPLES 16 to 20

Thermal transfer sheets for a full-color image according to the present invention were prepared in the same manner as that of Example 1, except that dyes, resin binders and additives specified in the following Table 3 were used.

TABLE 3

| Examples | Color | Dye | Resin binder | Additive |
|---|---|---|---|---|
| 16 | Y | Dye of formula (2): 4.0 parts | EC: 3.5 parts | None |
| | M | Dye of formula (3): 3.0 parts Dye of formula (4): 1.5 parts Dye of formula (5): 1.5 parts | EC: 3.0 parts S/HEMA/MA: 1.0 part | DCHP: 0.6 part |
| | C | Dye of formula (6): 3.5 parts Dye of formula (7): 1.0 part | EC: 1.0 part S/HEMA/MA: 2.5 parts | None |
| 17 | Y | Dye of formula (1): 4.0 parts Dye of formula (2): 1.0 part | EC: 3.0 parts S/HEMA/MA: 0.5 part | DCHP: 0.2 part |
| | M | Dye of formula (3): 3.0 parts Dye of formula (4): 0.5 part Dye of formula (5): 2.0 parts | EC: 3.5 parts | None |
| | C | Dye of formula (6): 3.5 parts Dye of formula (7): 2.0 parts | EC: 2.5 parts S/HEMA/MA: 1.0 part | None |
| 18 | Y | Dye of formula (1): 1.0 part Dye of formula (2): 3.0 parts | S/HEMA/MA: 3.0 parts | DCHP: 0.8 part |
| | M | Dye of formula (3): 3.0 parts Dye of formula (4): 1.0 part Dye of formula (5): 1.0 part | EC: 3.2 parts | None |
| | C | Dye of formula (6): 1.0 part Dye of formula (7): 3.0 parts | EC: 2.5 parts | None |
| 19 | Y | Dye of formula (2): 4.0 parts | EC: 2.5 parts S/HEMA/MA: 1.0 part | DCHP: 0.1 part |
| | M | Dye of formula (3): 3.0 parts Dye of formula (5): 2.0 parts | EC: 3.0 parts S/HEMA/MA: 0.5 part | DCHP: 0.5 part |
| | C | Dye of formula (6): 3.6 parts | EC: 3.5 parts | DCHP: 0.05 part |
| 20 | Y | Dye of formula (1): 0.5 part Dye of formula (2): 4.0 parts | EC: 3.2 parts | None |
| | M | Dye of formula (3): 1.5 parts Dye of formula (4): 1.5 parts Dye of formula (5): 1.5 parts | EC: 3.0 parts S/HEMA/MA: 0.5 part | None |
| | C | Dye of formula (6): 3.0 parts Dye of formula (7): 1.0 part | EC: 3.5 parts | None |

Note)
EC: ethyl cellulose
S/HEMA/MA: styrene/hydroxyethyl methacrylate/methyl methacrylate copolymer
DCHP: dicyclohexyl phthalate

EXAMPLES 21 to 23

Comparative thermal transfer sheets for a full-color image were prepared in the same manner as that of Example 1, except that dyes, resin binders and additives specified in the following Table 4 were used.

TABLE 4

| Examples | Color | Dye | Resin binder | Additive |
|---|---|---|---|---|
| 21 | Y | Dye of formula (1): 3.0 parts | Polystyrene: 3.5 parts | DCHP: 0.5 part |
| | M | Dye of formula (5): 2.8 parts | Cellulose diacetate: 4.0 parts | DCHP: 0.5 part |
| | C | Dye of formula (6): 3.5 parts | Polymethyl methacrylate: 4.0 parts | DCHP: 0.5 part |
| 22 | Y | Dye of formula (2): 3.5 parts | Polyvinyl butyral: 4.0 parts | None |
| | M | Dye of formula (3): 3.0 parts Dye of formula (4): 1.0 part | Polystyrene: 4.0 parts | DCHP: 0.1 part |

TABLE 4-continued

| Examples | Color | Dye | Resin binder | Additive |
|---|---|---|---|---|
| | C | Dye of formula (7): 3.0 parts | Acrylonitrile/ styrene copolymer: 4.0 parts | None |
| 23 | Y | Dye of formula (1): 2.0 parts Dye of formula (2): 2.0 parts | Styrene/methyl methacrylate copolymer: 4.0 parts | DCHP: 0.2 part |
| | M | Dye of formula (3): 2.0 parts Dye of formula (5): 2.0 parts | Polymethyl methacrylate: 3.5 parts | None |
| | C | Dye of formula (6): 3.0 parts Dye of formula (7): 1.0 part | Cellulose diacetate: 4.0 parts | None |

Each of the above-described thermal transfer sheets of the present invention and comparative thermal transfer sheets and the above-described material to which an image is to be transferred were put on top of the other in such a manner that the dye layer and the dye-receiving surface faced each other. Recording was carried out by means of a thermal head from the back surface of the thermal transfer sheet under conditions of a head applied voltage of 10 V and a printing time of 4.0 msec/line to provide full-color images comprising three primary colors. The density of the three color components at shadow portions of these images were evaluated, and the results were as given in Table 5.

TABLE 5

| Examples | Image density | | | Image density | |
|---|---|---|---|---|---|
| 15 | Yellow | 2.20 | 20 | Yellow | 2.18 |
| | Magenta | 2.32 | | Magenta | 2.23 |
| | Cyan | 2.47 | | Cyan | 2.30 |
| 16 | Yellow | 2.27 | 21 | Yellow | 1.74 |
| | Magenta | 2.47 | | Magenta | 1.61 |
| | Cyan | 2.32 | | Cyan | 1.59 |
| 17 | Yellow | 2.53 | 22 | Yellow | 1.68 |
| | Magenta | 2.38 | | Magenta | 1.72 |
| | Cyan | 2.30 | | Cyan | 1.57 |
| 18 | Yellow | 2.38 | 23 | Yellow | 1.72 |
| | Magenta | 2.27 | | Magenta | 1.60 |
| | Cyan | 2.42 | | Cyan | 1.54 |
| 19 | Yellow | 2.25 | | | |
| | Magenta | 2.44 | | | |
| | Cyan | 2.42 | | | |

EXAMPLE 24

A thermal transfer sheet was prepared in the same manner as that of Example 1, except that the compositions for the respective dye layers used were as follows.

| | |
|---|---|
| Yellow dye layer | |
| Dye of the formula (1) | 3.0 parts |
| Dye of the formula (2) | 1.0 part |
| Dye of the formula (5) | 0.3 part |
| Magenta dye layer | |
| Dye of the formula (3) | 4.0 parts |
| Dye of the formula (4) | 1.0 part |
| Dye of the formula (5) | 2.0 parts |
| Dye of the formula (1) | 0.5 part |

-continued

| | |
|---|---|
| Cyan dye layer | |
| Dye of the formula (6) | 1.3 parts |
| Dye of the formula (7) | 1.2 parts |
| Dye of the formula (8) | 3.0 parts |

A material to which an image to be transferred was prepared in the same manner as that described above, except that the composition for an image-receiving layer comprised the following components. The above thermal transfer sheet and the material to which an image is to be transferred were put on top of the other in such a manner that the dye layer and the dye-receiving surface faced each other. Recording was carried out by means of a thermal head from the back surface of the thermal transfer sheet under conditions of a head applied voltage of 15.5 V and a printing time of 8.0 msec/line to effect printing of three colors of yellow, magenta cyan.

| Composition for image-receiving layer | |
|---|---|
| Polyester resin (Vylon 200 manufactured by Toyobo Co., Ltd.) | 11.5 parts |
| Vinyl chloride/vinyl acetate copolymer (VYHH manufactured by UCC) | 5.0 parts |
| Amino-modified silicone (KF-393 manufactured by The Shin-Etsu Chemical Co., Ltd.) | 1.2 parts |
| Epoxy-modified silicone (X-22-343 manufactured by The Shin-Etsu Chemical Co., Ltd.) | 1.2 parts |
| Methyl ethyl ketone/toluene/ cyclohexanone (weight ratio = 4:4:2) | 102.0 parts |

The prints were subjected to measurement of L*, a* and b* values based on CIE1976 using MINOLTA CR-221 (light source: D65, angle of visibility: 10° ).

The results are given in Table 6. L*, a* and b* reference values are values for SWOP color reference obtained by measurement in the same manner as that described above. Further, for comparison, L*, a* and b* values obtained in Example 13 were also given in Table 6.

TABLE 6

| | | SWOP | Ex. 24 | Ex. 13 |
|---|---|---|---|---|
| Ye | L* | 84.61 | 86.72 | 91.37 |
| | a* | −12.50 | −15.03 | −18.29 |
| | b* | 85.85 | 86.21 | 87.55 |
| Mg | L* | 43.72 | 45.26 | 48.22 |
| | a* | 73.85 | 74.21 | 83.19 |
| | b* | −5.82 | −6.37 | −29.35 |
| Cy | L* | 55.35 | 55.82 | 58.55 |
| | a* | −23.40 | −20.11 | −28.45 |
| | b* | −37.31 | −38.25 | −43.18 |

EXAMPLE 25

A thermal transfer sheet was prepared in the same manner as that of Example 24, except that the compositions for the respective dye layers used were as follows.

| | |
|---|---|
| Yellow dye layer | |
| Dye of the formula (1) | 3.0 parts |
| Dye of the formula (2) | 1.2 parts |
| Dye of the formula (5) | 0.2 part |
| Magenta dye layer | |
| Dye of the formula (3) | 3.0 parts |
| Dye of the formula (4) | 1.0 part |
| Dye of the formula (5) | 2.0 parts |
| Dye of the formula (1) | 0.6 part |
| Cyan dye layer | |
| Dye of the formula (6) | 0.7 part |
| Dye of the formula (7) | 2.0 parts |
| Dye of the formula (8) | 2.0 parts |

The thermal transfer sheet was subjected to measurement of L*, a* and b* values based on CIE1976 as described in Example 24. The results are given in Table 7. L*, a* and b* reference values are those for Euro color reference obtained by measurement in the same manner as that described above. Further, for comparison, L*, a* and b* values obtained in Example 13 were also given in Table 7.

TABLE 7

| | | Euro Color | Ex. 25 | 24 Ex. 13 |
|---|---|---|---|---|
| Ye | L* | 89.87 | 88.58 | 91.37 |
| | a* | −13.15 | −14.05 | −18.29 |
| | b* | 94.27 | 93.15 | 87.55 |
| Mg | L* | 48.22 | 49.56 | 48.22 |
| | a* | 69.25 | 68.75 | 83.19 |
| | b* | 1.34 | 0.92 | −29.35 |
| Cy | L* | 55.24 | 56.11 | 58.55 |
| | a* | −19.88 | −17.95 | −28.45 |
| | b* | −54.25 | −52.18 | −43.18 |

Comparative Example 1

A thermal transfer sheet was prepared in the same manner as that of Example 1, except that the compositions for the respective dye layers used were as follows.

| | |
|---|---|
| Yellow dye layer | |
| Dye of the formula (1) | 3.0 parts |
| Magenta dye layer | |
| Dye of the formula (4) | 2.0 parts |
| Dye of the formula (5) | 1.1 parts |
| Cyan dye layer | |
| Dye of the formula (8) | 3.5 parts |

Evaluation of Color Reproduction

Each of the thermal transfer sheet formed in Example 13 and the thermal transfer sheet formed in Comparative Example 1 and the above-described material to which an image is to be transferred were put on top of the other in such a manner that the dye layer and the dye-receiving surface faced each other. Recording was carried out by means of a thermal head from the back surface of the thermal transfer sheet under conditions of a head applied voltage of 17 V and a printing time of 8.0 msec/line to effect printing of three colors of yellow, magenta and cyan and secondary colors of red, green and blue.

Figure 7:
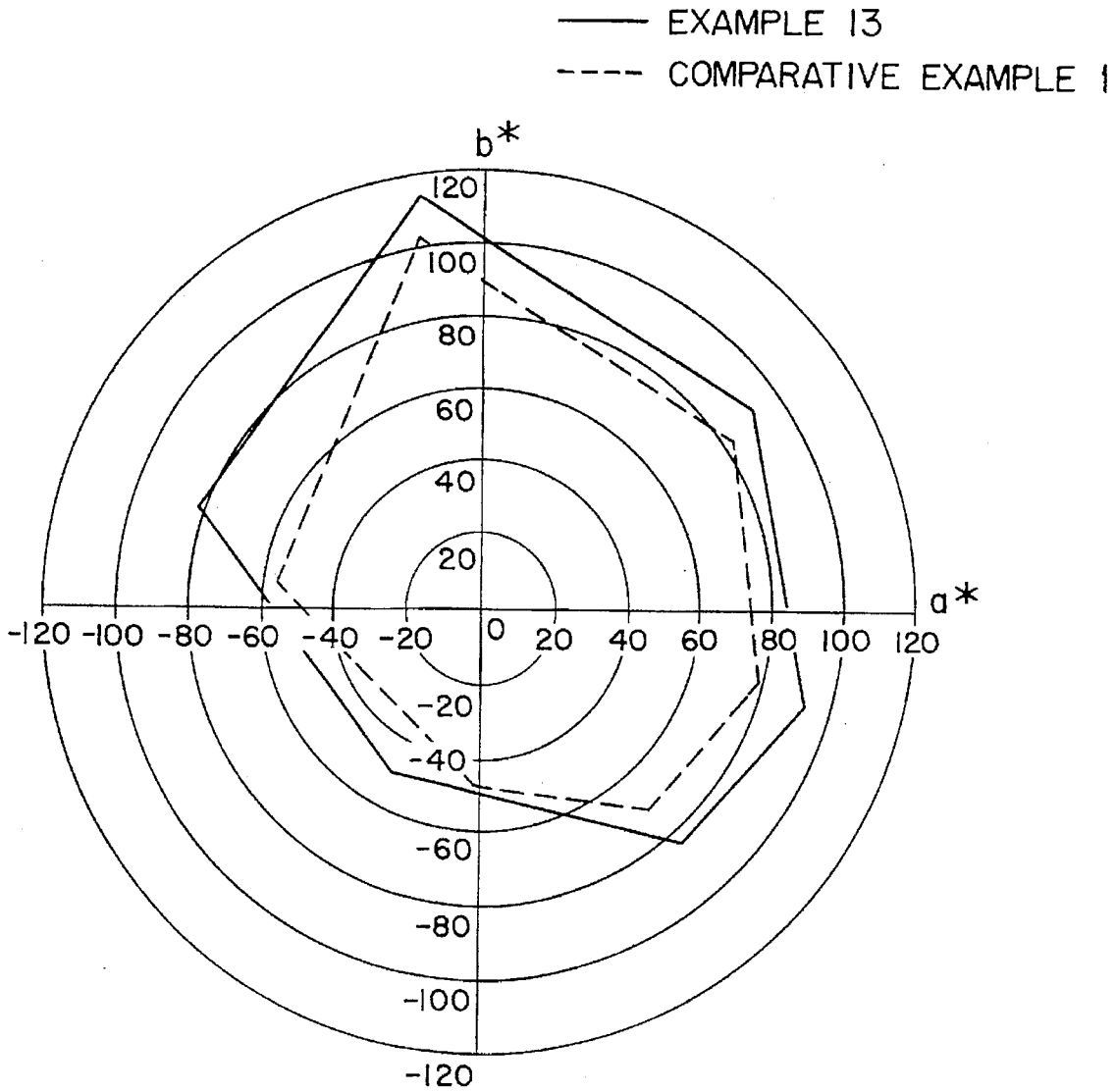
FIG. 7 is a color circle diagram under CIE1976.

The thermal transfer sheet was subjected to measurement of L*, a* and b* values based on CIE1976 as described in Example 24. The results are shown in FIG. 7.

As described above, according to the present invention, a thermal transfer sheet capable of forming a full-color image having an excellent light fastness can be provided by successively forming on a substrate sheet dye layers of three colors using particular dyes.

Further, a thermal transfer sheet capable of exhibiting an excellent hue suitable for printing correction can be provided by selecting particular dyes and using them in a particular component ratio.

Further, a thermal transfer sheet for the formation of a full-color image, which has a high heat sensitivity and a good color density even in the case of application of a low thermal energy and can realize very excellent reproduction in a wide range of colors, can be provided by successively forming on a substrate sheet dye layers of three colors using combinations of particular dyes and resin binders.

We claim:

1. A thermal transfer sheet for the formation of a color image, comprising:

a substrate sheet; and dye layers of at least yellow, magenta and cyan formed on one surface of said substrate sheet in a successive manner, said dye layers respectively comprising dyes of three colors of yellow, magenta and cyan and resin binders for each respective dye, wherein said yellow dye is a dye represented by at least one of the following formulae (1) and (2), said magenta dye is represented by the following formula (3), and said cyan dye is a dye represented by at least one of the following formulae (4) and (5):

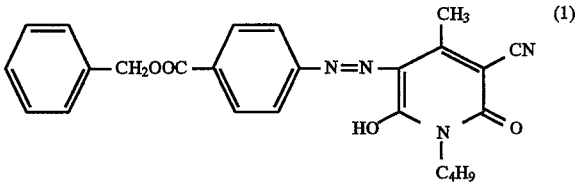

(1)

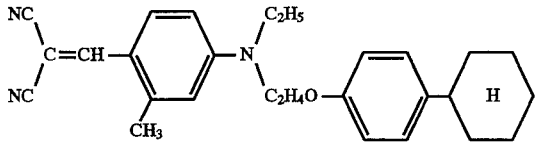

(2)

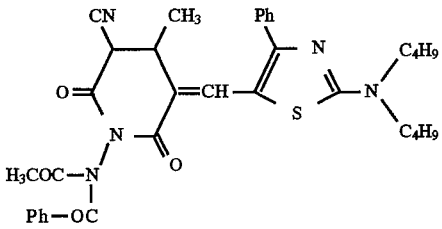

(3)

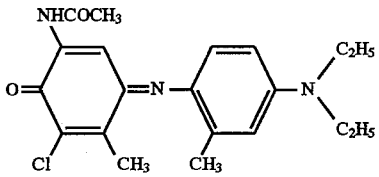

(4)

-continued (5)

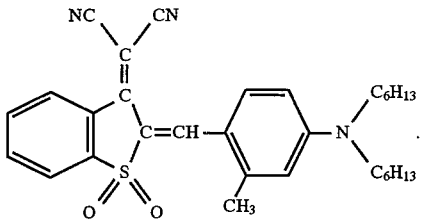

2. The thermal transfer sheet of claim 1, wherein said cyan dye layer further comprises a dye represented by the following formula (6):

(6)

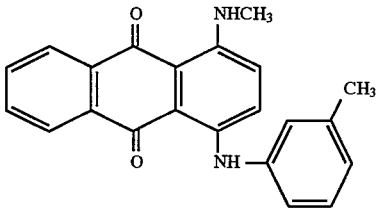

3. The thermal transfer sheet of claim 2, wherein said magenta dye layer further comprises a dye represented by formula (1).

4. The thermal transfer sheet of claim 1, wherein said magenta dye layer further comprises a dye represented by formula (1).

5. The thermal transfer sheet of claim 1, wherein said resin binder for said each dye layer comprises a polyvinyl acetoacetal resin.

6. The thermal transfer sheet of claim 5, wherein said each dye layer further comprises polyethylene wax particles.

7. The thermal transfer sheet of claim 1, further comprising a black dye layer.

8. The thermal transfer sheet of claim 7, wherein said each dye layer further comprises polyethylene wax particles.

9. The thermal transfer sheet of claim 1, wherein said each dye layer further comprises polyethylene wax particles.

10. The thermal transfer sheet of claim 1, wherein said resin binder for the yellow dye layer and the magenta dye layer comprises at least one of ethyl cellulose and a styrene/hydroxyethyl methacrylate/methyl methacrylate copolymer, and said resin binder for the cyan dye layer comprises ethyl cellulose.

11. The thermal transfer sheet of claim 1, wherein at least one of said dye layers contains dicyclohexyl phthalate.

* * * * *